US005797452A

United States Patent [19]

Martin

[11] Patent Number: 5,797,452

[45] Date of Patent: Aug. 25, 1998

[54] DOUBLE-ACTING, DEEP-WELL FLUID EXTRACTION PUMP

[76] Inventor: John Kaal Martin, 2514 Old Fort Rd., Sugarland, Tex. 77479

[21] Appl. No.: 764,339

[22] Filed: Dec. 12, 1996

[51] Int. Cl.[6] ..... E21B 27/00

[52] U.S. Cl. ..... 166/110; 417/263; 417/264; 417/403

[58] Field of Search ..... 166/105, 372, 166/375, 110; 417/254, 259, 263, 264, 403

[56] References Cited

U.S. PATENT DOCUMENTS

| | | | |
|---|---|---|---|
| 3,922,116 | 11/1975 | Pugh | 417/393 |
| 4,214,854 | 7/1980 | Roeder | 417/402 |
| 4,293,287 | 10/1981 | Carrens | 417/393 |
| 4,295,801 | 10/1981 | Bennett | 417/397 |
| 4,403,919 | 9/1983 | Stanton et al. | 417/53 |
| 4,477,234 | 10/1984 | Roeder | 417/393 |
| 4,516,917 | 5/1985 | Canalizo | 417/393 X |
| 4,544,335 | 10/1985 | Roeder | 417/401 |
| 4,726,743 | 2/1988 | Watts | 417/400 |
| 4,768,589 | 9/1988 | Roeder | 166/106 X |
| 5,494,102 | 2/1996 | Schulte | 166/105.6 |

*Primary Examiner*—Roger J. Schoeppel
*Attorney, Agent, or Firm*—Maryam Bani-Jamali

[57] ABSTRACT

This invention provides the structure and operation of a double-acting, deep-well fluid extraction pump assembly which includes a power piston housed on top of a pumping piston along with a power control system. The pumping piston has a dynamic, reciprocating, bi-directionally self-cleaning, suction filter and houses poppet-type, uni-directional, fluid flow control valves that control the inflow and outflow of extracted fluid through the pumping piston. Gland membranes and a number of double-acting, lineal, fluid motor pistons divide the power piston into pressure chambers and into fluid conduits, with the divisions con-jointly providing a path for inflow of hydraulic power fluid and a path for outflow of extracted fluid. The power control system includes a four-way, directional, flow-control valve for controlling cycling frequency, a timer and a flow switch for controlling recovery periods, an unloading relief valve for controlling fluid pressure and a flow-control valve for controlling pumping speed. When hydraulic power fluid flows from the power control system into the power piston through one conduit, extracted fluid flows from the pumping piston out of the power piston to the power control system from the other conduit.

16 Claims, 8 Drawing Sheets

To FIG. 3F

DOUBLE-ACTING, DEEP-WELL FLUID EXTRACTION PUMP

BACKGROUND OF THE INVENTION

1. Field of the Invention

This invention relates to the structure and operation of a double-acting, deep-well fluid extraction pump assembly which comprises a power piston housed on top of a pumping piston. The pumping piston houses poppet-type, unidirectional, fluid flow control valves that control the inflow and outflow of extracted fluid through the pumping piston. Gland membranes and a number of double-acting, lineal, fluid motor pistons divide the power piston into pressure chambers and into fluid conduits, with the divisions conjointly providing a path for inflow and a path for outflow of fluid. When hydraulic power fluid flows from a power control system into the power piston through one conduit, extracted fluid flows from the pumping piston out of the power piston to the power control system from the other conduit.

2. Description of the Prior Art

A wide variety of pumps have been used in an attempt to increase the efficiency of deep-well, fluid extraction. Deep-well, fluid extraction pumps, used for the extraction of petroleum fluids, brine or water, have been designed to fit into large bore wells and are single-acting pumps that are useful for pumping straight and vertical wells.

Fluid passages and valves for any motor fluid and for any pumped fluid dictate certain minimum sizes which, in turn, define a minimum envelope for a down-hole pump. Establishment of minimal sizes may not be applicable to small-bore wells and may only have to be limited to large-bore wells. The miniaturization of the valving, as well as constant existence of contaminants (including but not limited to sand) in the pumped fluid, have made previous pumps unreliable.

A number of patents have been issued which have attempted to solve problems related to deep-well, fluid extraction. A summary of some of the more relevant patents follows.

Reese, U.S. Pat. No. 4,383,803, was issued on May 17, 1983. Reese patents a device for lifting liquid from boreholes, said device comprising: a pump being located downhole near production formation and consisting of a fluid-actuated, double-action piston. The pump is connected by fluid pressure lines to a source of fluid pressure disposed above ground and a switching valve is connected to provide fluid pressure to alternate sides of the piston to effect reciprocation thereof.

Bennett, U.S. Pat. No. 4,295,801, was issued on Oct. 20, 1981. Bennett patents a small-diameter, fluid-powered, submersible, sampling pump including an elongated, cylindrical body formed by: a pair of hollow pressure chambers of a motor piston and a centrally-disposed, control-valve, block assembly containing, in axial alignment with the motor piston, a spool pilot valve and a spool fluid-distribution valve. The spool pilot valve comprises a valve housing defining a large, central, piston pressure chamber; a relatively small bore extending axially inwardly from one end of the valve housing and into communication with the large, central, piston pressure chamber; and a larger bore of smaller diameter than the central, piston pressure chamber extending axially into the opposite end of the valve housing into communication with the central, piston pressure chamber. A small piston is slidably positioned in the relatively small bore, a larger piston in the larger bore and the largest piston in the central piston pressure chamber. A power fluid charging port communicates with the central piston pressure chamber through the valve housing, such that sealing means on the largest piston in the central piston pressure chamber allows power fluid to bleed from the power fluid charging port to opposite sides of the largest piston when the sealing means is directly aligned with the power fluid charging port.

The hydraulically-operated, deep-well, fluid extraction pump assemblies of previous art have the directional fluid flow control valve, installed within the mechanism of the pumping piston, in order to reduce the time required for the travel of pressure shock waves, in the power line(s), at the cost of high failure rate of the built-in, directional-flow, control valve, in sand laden ambient.

It is desirable to develop a hydraulically-operated, deep-well, fluid-extraction pump that would overcome the above defects while being capable of pumping crude oil from low-production wells and water from gas-producing wells.

SUMMARY OF THE INVENTION

A primary object of the present invention is to provide a pump assembly for extracting crude oil from low-production wells and water from gas-producing wells.

Another object of the present invention is to design a double-acting, deep-well, fluid extraction pump that is simple in construction, reliable in operation and relatively inexpensive to manufacture.

Yet another object of the invention is to design a fluid extraction pump which can fit into very small well bores.

An additional object of the present invention is to provide a hydraulically-operated, fluid extraction pump assembly which undergoes minimal change in its power requirement for different depths of fluid columns.

Another object of this invention is to provide a hydraulically-operated, fluid extraction pump assembly that uses self-cleaning, dynamic, suction filters in order to reduce ingestion of contaminants in the well fluid.

A further object of this invention is to design a hydraulically-operated, fluid extraction pump that has a maximal service life.

A further object of this invention is to provide a fluid extraction pump assembly that eliminates the formation of gas and vapor locks during pumping operation.

A final object of the present invention is to provide a hydraulically-operated, deep-well, fluid extraction pump assembly having a hydraulic-power, control system which is responsive to production output of the well.

Additional objects and advantages of the invention will be set forth in part in a detailed description which follows, and in part will be obvious from the description, or may be learned by practice of the invention.

The present invention provides a double-acting, deep-well fluid extraction pump, comprising a pumping piston and a power piston. The fluid extraction pump is connected to a power control system having a four-way, directional, flow control valve (referred to hereafter as "four-way valve"). The four-way valve repeatedly switches flow of hydraulic power fluid (i.e. pressurized recycled fluid) into and extracted fluid out of the fluid extraction pump between two paths and through two ports. One fluid path (referred to as an "inner conduit") extends through an inner tubular piston rod and the other fluid path (referred to as a "crescent space") extends around the inner tubular piston rod and within an outer tubular piston rod. The outer tubular piston rod and the inner tubular piston rod open into individually assigned pressure chambers that are formed between gland membranes in the power piston. Double-acting, lineal, fluid motor pistons exist in separate pressure chambers. Downwardly-flowing fluid in the outer tubular piston rod exerts forces, on the fluid motor pistons, that are in the opposite direction to forces exerted, on the same fluid motor pistons, by fluid flowing downwards in the inner tubular piston rod.

The pumping piston comprises poppet-type, uni-directional, fluid-flow control valves particularly arranged to avoid any contact between the fluid of the outer tubular piston rod and of the inner tubular piston rod. Although arranged linearly, the poppet-type check valves are connected to diverter ports that divert the flow of the fluid through the pumping piston. A lower, longitudinal, tubular extension of the pumping piston serves as a suction tube.

With the four-way valve changing the flow pattern of the hydraulic power fluid from parallel-flow pattern of porting to crossed-flow pattern of porting, the pressure of a hydraulic pump of the power control system energizes, consecutively and alternately, two ports and their assigned hydraulic power fluid flow passage (referred to hereafter as "hydraulic power fluid line P"). The port and the fluid discharge line T that are not receiving the hydraulic power fluid, provide outlet fluid to an extracted-fluid tank.

In a parallel-flow pattern of porting, the hydraulic power fluid flows through port A into path 2 and, simultaneously, acts upon the left-pilot, circuit operator of the four-way valve. The fluid in path 2 flows through a conduit into and, then, out of an assigned manifold. The downwardly-flowing fluid enters pressure chambers that are each located under a fluid motor piston and exerts sufficient pressure under each fluid motor piston to move the outer and inner tubular piston rods upwards. The upstroke results in the extraction of fluid, with the extracted fluid flowing through the suction tube and through the assigned poppet-type valve and collecting in the lowest pressure chamber that leads to crescent space of the outer tubular piston rod. Meanwhile, the upward movement of the fluid motor pistons causes an increase in a previously-existing pressure of the pressure chambers which lead to the inner tubular piston rod, said increased pressure resulting in the discharge of fluid from port B, through fluid discharge line T and into the extracted-fluid tank.

The crossed-flow pattern of porting is a mirror image of the parallel-flow pattern of porting. After an appropriate time delay, the left-pilot, circuit operator of the four-way valve reverses the flow pattern of hydraulic power fluid, resulting in a crossed-flow pattern of porting. The hydraulic power fluid flows through port B and path 1 towards the inner tubular piston rod, and simultaneously acts upon the right-pilot, circuit operator of the four-way valve. Return flow to the extracted-fluid tank is through path 2 and port A. The fluid in path 1 flows through a conduit into and, then, out of an assigned manifold. The downwardly-flowing hydraulic power fluid enters pressure chambers that are each located over a fluid motor piston and exerts sufficient pressure over each fluid motor piston to move the inner and outer tubular piston rods downward. Downstrokes result in the flow of well fluid through the assigned poppet-type check valves into the upper pressure chamber of the pumping piston leading to the inner tubular piston rod. Meanwhile, the downward movement of the fluid motor pistons causes an increase in a previously-existing pressure of the pressure chambers which lead to the outer tubular piston rod, the increased pressure resulting in the discharge of fluid from port A, through fluid discharge line T and into the extracted-fluid tank. After an appropriate time delay, the right-pilot, circuit operator of the four-way valve reverses the flow pattern of hydraulic power fluid, resetting a parallel-flow pattern of porting.

In the absence of a required extracted fluid flow, a timer delays the operation of the fluid extraction pump assembly and a well-recovery cycle commences.

It is to be understood that the descriptions of this invention are exemplary and explanatory, but are not restrictive, of the invention. Other objects and advantages of this invention will become apparent from the following specification and from any accompanying charts, tables, examples and drawings.

BRIEF DESCRIPTION OF CHARTS, TABLES, EXAMPLES AND DRAWINGS

Any accompanying charts, tables, examples and drawings which are incorporated in and constitute a part of this specification, illustrate examples of preferred embodiments of the invention and, along with the description, serve to explain the principles of the invention.

DETAILED DESCRIPTION OF THE PREFERRED EMBODIMENT

A detailed description of preferred embodiments of the present invention follows. Preferred embodiments of the invention are illustrated in any charts, tables, examples and drawings that are included.

The present invention provides a double-acting, deep-well fluid extraction pump 169 (referred to hereafter as "fluid extraction pump") that is designed for the specific duty of pumping crude oil from low-production wells and water from gas-producing wells. A power control system 170, that is preferably installed above ground level in order to allow easy access, is used to control fluid flow through the fluid extraction pump 169. Figures of the preferred embodiments of the power control system 170 and of the fluid extraction pump 169 are attached. These figures are not intended to limit the scope of this invention. In addition, a detailed description of some components that play a significant role in the configuration, as well as in the operation, of the fluid extraction pump 169 and of the power control system 170 is provided. The structure and operation of the power control system 170, and then of the fluid extraction pump 169, follow.

Structure and Operation of the Power Control System

A detailed description of the power control system 170 and its operation are jointly included due to the vital role of the power control system 170 in the operation of the fluid extraction pump 169.

Figure 1:
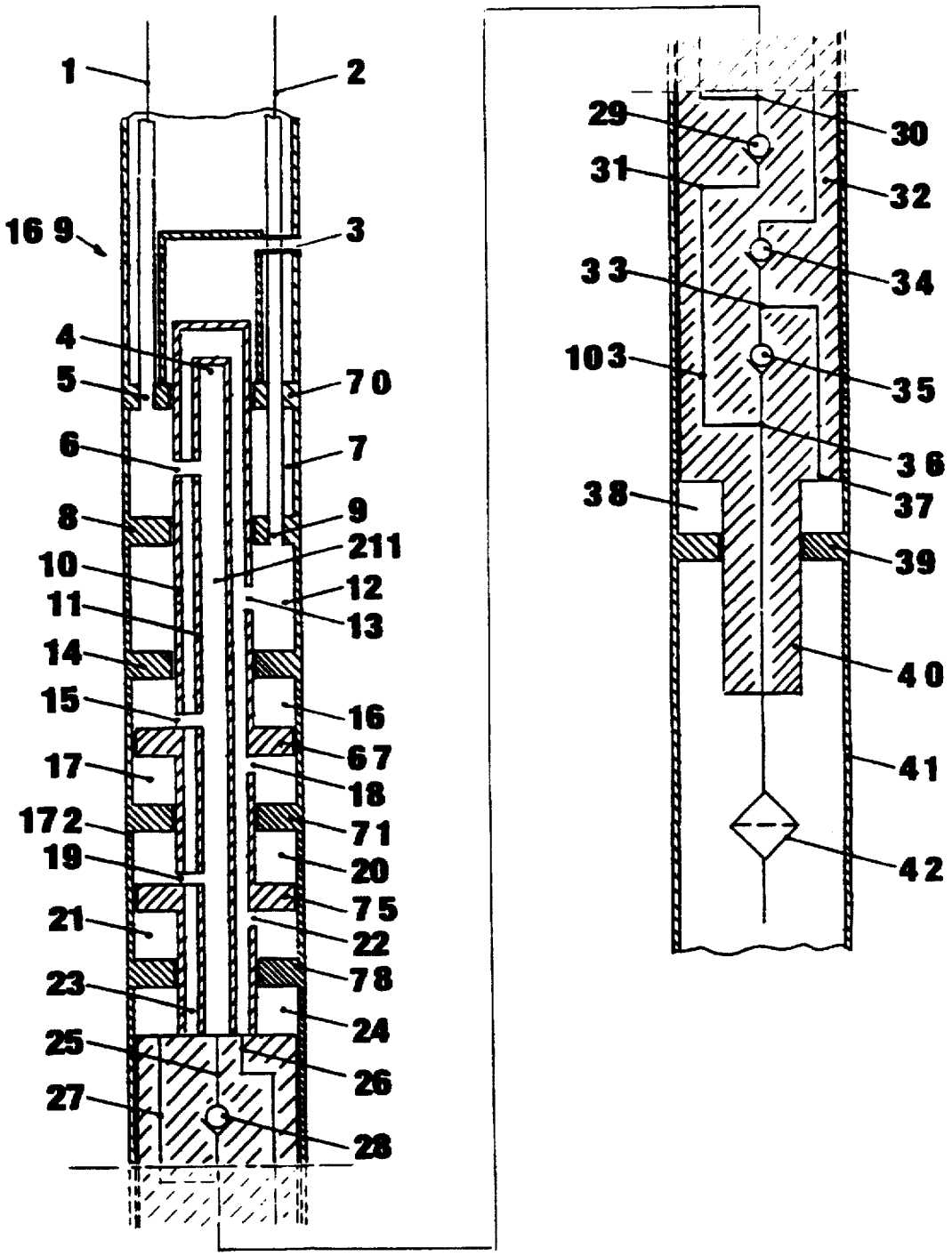
FIG. 1 shows a schematic, cross-sectional view of a double-acting, deep-well fluid extraction pump having a power piston and a pumping piston.
Figure 2:
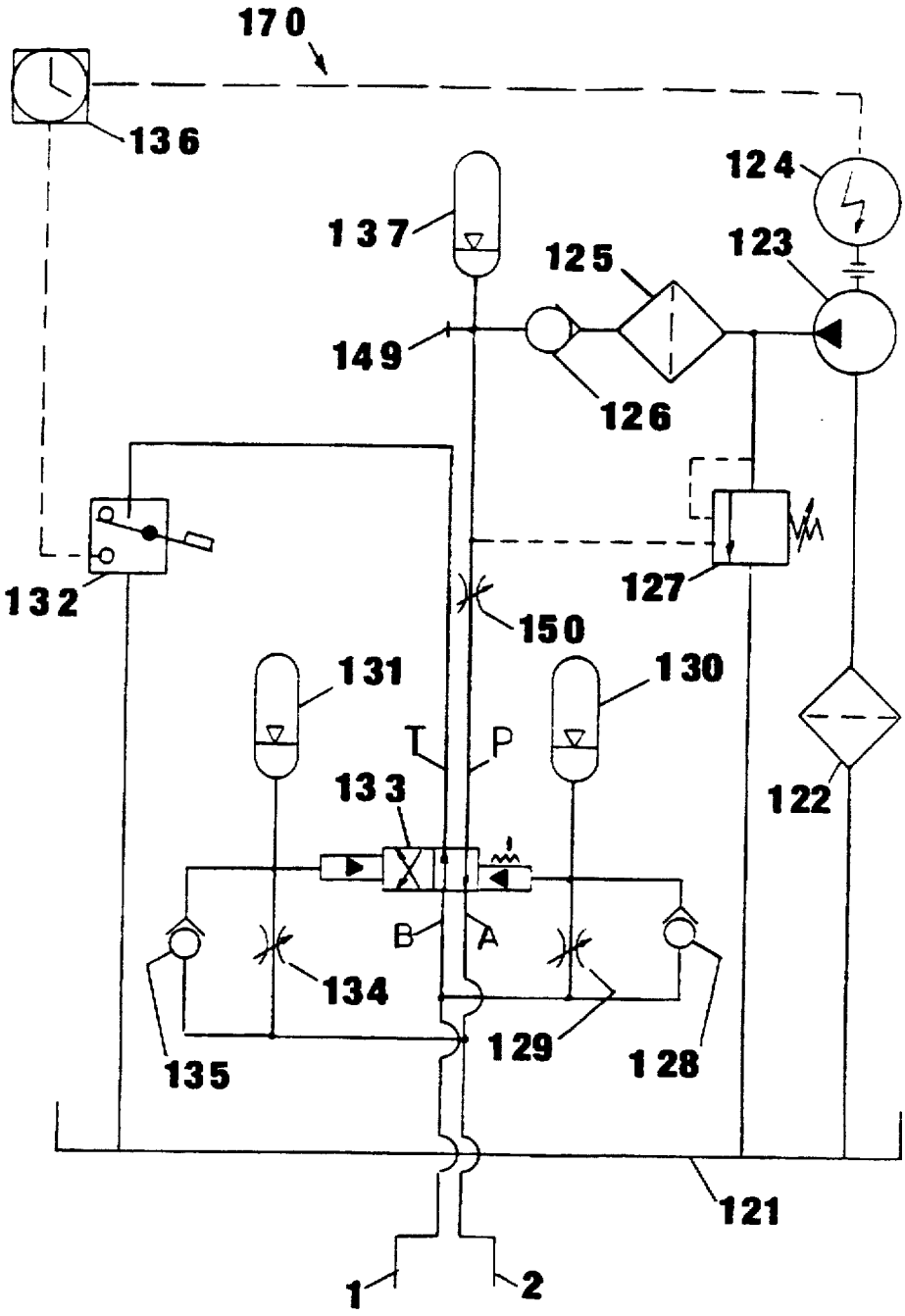
FIG. 2 is a schematic arrangement of fluid power elements of a power control system that provides hydraulic power fluid for the fluid extraction pump of FIG. 1.

As demonstrated in FIG. 1 and FIG. 2, the power control system 170 is connected to the fluid extraction pump 169 through two separate paths (referred to hereafter as path 1 and path 2). A four-way, directional, flow-control valve 133, with a left-pilot and a right-pilot, is a major component of the power control system 170. The four-way valve 133, having control over cycling, alternates the flow of well fluid to and from the fluid extraction pump 169 between path 1 (through port B) and path 2 (through port A). The four-way valve 133 alternately connects to path 1 and path 2 a hydraulic power fluid line P that provides pressurized recycled fluid and that leads to the fluid extraction pump 169. Simultaneously, the four-way valve 133 alternately connects path 2 and path 1 to a fluid discharge line T that leaves the fluid extraction pump 169. Thus, when fluid flows from hydraulic power fluid line P through port A to path 2, fluid from path 1 flows through port B to fluid discharge line T (this period being arbitrarily referred to as the "first suction half-cycle"). On the other hand, when fluid flows from hydraulic power fluid line P through port B to path 1, fluid from path 2 flows through port A to fluid discharge line T (this period being arbitrarily referred to as the "second suction half-cycle"). The four-way valve 133 is equipped for adjustment of the cycle timing. Upon timed commands of the timing circuit, conduction of pressurized fluid flow is reversed (marking the start of the first or second suction half-cycle) by the four-way valve 133.

Timing of the pumping cycle and the dwell period at the termination of each cycle are adjustable by flow control devices at each end of the four-way valve 133. Adjustable, flow-control valves 129 and 134 (or needle valves) function in combination with accumulators 130 and 131 and check valves 128 and 135 to cause cyclic reversals of the fluid patterns of the four-way valve 133. Accumulators 130 and 131, which are preferably gas-loaded or spring-loaded, are used to provide the elasticity required for the switching operation of the four-way valve 133. Check valves 128 and 135, as it is commonly known, have a stationary seat, a movable poppet and a spring. Flow-control valve 134, accumulator 131 and check valve 135 are interconnected and positioned on a path that is a diversion from path 2 and that is directed to the left-pilot of the four-way valve 133. (Please refer to FIG. 2.) Flow-control valve 129, accumulator 130 and check valve 128 are interconnected and positioned on a path that is a diversion from path 1 and that is directed to the right-pilot of the four-way valve 133.

In the first suction half-cycle, while the fluid flows through hydraulic power fluid line P to port A, a fraction of the fluid diverts to accumulator 131 through flow-control valve 134. At this time when port B leads to fluid discharge line T, accumulator 130 depressurizes the remaining excess pressure of the previously pressurized fluid on the right of the four-way valve 133 through check valve 128. Flow-control valve 134 limits the flow of the fluid to accumulator 131. The pressurized fluid that passes through flow-control valve 134 gradually fills up accumulator 131, compressing the gas or the spring of accumulator 131 until the pressure of the gas or the spring upon pilot fluid exceeds the holding force of an opposing detent (which is on one side of the four-way valve 133 and resists a tendency of shifting). Check valve 135 blocks the flow of fluid, flowing temporarily to accumulator 131, but allows flow of fluid through flow-control valve 134 to accumulator 131, until static pressure at the left inlet of the four-way valve 133, working over the exposed area of the movable spool of the four-way valve 133, creates sufficient force to overcome friction and the resisting force of the spring-loaded retainer (ball detent) of the four-way valve 133. Upon filling-up of accumulator 131, static pressure replaces the dynamic pressure of the fluid on the left of the four-way valve 133. When the fluid pressure at the left of the left pilot exerts sufficient force to overcome the resisting force of the ball detent and of static friction, the spool is forced out of its resting position, the four-way valve 133 shifts rightwards and the discharge flow of hydraulic power fluid starts through the poppet of check valve 128. The rightward shift of the four-way valve 133 is due to the elasticity of the pressure exerted upon the fluid in accumulator 131. At this time, when port A leads to fluid discharge line T, accumulator 131 depressurizes the remaining excess pressure of the previously pressurized fluid on the left of the four-way valve 133 through check valve 135.

When the four-way valve 133 shifts rightwards, the pattern of fluid flow through the four-way valve 133 reverses and the second suction half-cycle commences. The arrangement and function of flow-control valve 129, accumulator 130 and check valve 128 and of flow-control valve 134, accumulator 131 and check valve 135, respectively, are directly comparable. Hydraulic power fluid line P leads through port B to path 1, while path 2 leads through port A to fluid discharge line T. While the pressure through hydraulic power fluid line P passes to port B, a fraction of the fluid is directed to accumulator 130 through flow-control valve 129. When the fluid pressure at the right of the right pilot exerts sufficient force to overcome the resisting force of the ball detent and of static friction, the spool is forced out of its resting position, the four-way valve 133 shifts leftwards and the discharge flow of hydraulic fluid starts through the poppet of check valve 135. The leftward shift of the four-way valve 133 is due to the elasticity of the pressure exerted upon the fluid in accumulator 130. At this time, when port B leads to fluid discharge line T, accumulator 130 depressurizes the remaining excess pressure of the previously pressurized fluid on the right of the four-way valve 133 through check valve 128.

The fluid leaving the four-way valve 133 through fluid discharge line T towards an extracted-fluid tank 121 undergoes the following route. Fluid discharge line T connects, through a flow switch 132, to the extracted-fluid tank 121 (referred to in FIG. 2). The flow-switch 132 controls a timer 136 which, in turn, controls a drive motor 124 of a hydraulic pump 123 of the power control system 170. (Please note that although the drive motor 124 is an electric motor in the preferred embodiment, no limitation exists on the type of the drive motor 124. By using proper equipment, an internal combustion engine qualifies, operating in a similar fashion. In appropriate conditions and with minor modifications, one central power control system 170 can supply hydraulic power for a plurality of nearby wells with individual cycling arrangements. Connections among the power control system 170 and other extraction pumps which require pressurized hydraulic fluid is by a temporarily closed outlet 149, preferably positioned on hydraulic power fluid line P.) As long as the sum of the hydraulic power fluid of the hydraulic pump 123 and the pumped fluid through fluid discharge line T is sufficient to retain the flow-switch 132 closed, the flow-switch 132 does not trigger the timer 136 and does not intervene in the energization of the drive motor 124. At some periods of time, the sum of the quantity of return flow from the operation of any lineal motors of the hydraulic pump 123 and the pumped fluid flowing through fluid discharge line T is not sufficient to maintain the flow switch 132 closed. Depletion of the available well fluid leads to the breakage of contact of the flow switch 132 with fluid discharge line T and, as a result, triggers the timer 136 to stop the drive motor 124 of the hydraulic pump 123, commencing a pre-set delay in the extraction. The recovery cycle, which is adjusted to allow re-establishment of well-fluid production, is a result of trial-and-error runs and lasts from a few minutes to several days. When the adjusted, pre-determined, time delay in extraction ends, the recovery cycle terminates and the timer 136 restarts the drive motor 124 of the hydraulic pump 123. Upon commencement of extraction, an excess flow of the extracted fluid through fluid discharge line T re-establishes contact of the flow switch 132 with fluid discharge line T.

The operator's control over the timer 136 allows achievement of a noticeable conservation of energy in fluid extractions. The timer 136 is adjustable, even automatically, to any setting in order to achieve the requested fluid flow and pressure and the most efficient results. A major portion of the energy used for generating the hydraulic over-pressure to operate the deep-well fluid extraction pump assembly 169 contributes to pumping the well fluid against the static fluid pressure of the discharge lines, overcoming the fluid friction of conduction lines and overcoming the friction of dynamic seals. By regulating the frequency of cycling and the flow of well fluid, the four-way valve 133 harmonizes the extraction velocity of the well fluid with the flow rate of fluid from the underground formation. In an ideally-matched operating condition, the flow rate of fluid leaving the fluid extraction pump assembly 169 is equal to the flow rate of fluid from the underground formation into the fluid extraction pump assembly 169 and, thus, the timer 136 for well recovery is seldom activated. The efficiency in the generated power leads to an extension in the life of the generating equipment of the power control system 170.

During the operation of the power control system 170, some components of the power control system 170 contribute to the control of traveling pressure waves and to the limitation of the maximum pressure in the power control system 170. Unloading relief valve 127 plays a vital role in protecting the hydraulic pump 123, operated by the drive motor 124, from over-pressure and pressure peaks. A detailed description of the set-up and operation of unloading relief valve 127 in controlling pressure on the hydraulic pump 123 follows. (Please refer to FIG. 2.) When pressure flow is required, fluid from the extracted-fluid tank 121 flows to the hydraulic pump 123 through at least one suction filter 122, which protects the hydraulic pump 123 from damage by large particles, and flows from the hydraulic pump 123 through a number of suction filters 122 which further filter the fluid from the extracted-fluid tank 121. (To simplify FIG. 2, only one suction filter 122 is demonstrated and is positioned between the extracted-fluid tank 121 and the hydraulic pump 123 although any number of suction filters 122 could be applied and suction filter(s) could be positioned between the hydraulic pump 123 and the pressure filter 125 as well.) The hydraulic pump 123 delivers pressurized fluid through pressure filter 125 and through flow-control valve 126 to accumulator 137 and to hydraulic power fluid line P. Adjustable, flow-control valve 150, positioned on the hydraulic power fluid line P between accumulator 137 and the four-way valve 133, controls flow of pressurized fluid to the four-way valve 133, and the ratio of pumping volume to fluid production from underground formation.

A preferred embodiment of the power control system 170 is presented in FIG. 2. The path to the hydraulic pump 123 and to suction filter 122 are located above, or at least above the bottom of, the extracted-fluid tank 121 in order to minimize suction of any settled contaminants therefrom. An interruption in the demand for pressurized fluid results in absorption of any excess amount of fluid that is passing through the hydraulic pump 123 by accumulator 137. Flow-control check valve 126 allows flow of fluid from pressure filter 125 to accumulator 137 until accumulator 137 is fully pressurized. Any additional injection of fluid from the hydraulic pump 123 leads to the communication of pressure from accumulator 137 to relief valve 127. To establish, within the power control system 170, an efficient hydraulic circuit that serves to dissipate excess energy of the pressurized fluid in the hydraulic circuit and to unload excess of fluid generated by the hydraulic pump 123 after accumulator 137 is fully pressurized, unloading relief valve 127 is preferably on a fluid discharge line that starts from the path between the hydraulic pump 123 and pressure filter 125 and terminates at the extracted-fluid tank 121. Before reaching a maximum pressure setting of unloading relief valve 127 (with unloading relief valve 127 having a hysteresis of approximately 10 $kg/cm^2$ to 15 $kg/cm^2$), relief valve 127 provides a relief function and serves to dissipate excess energy of the fluid flowing to relief valve 127 in the form of heat. When the hydraulic circuit reaches a maximum pressure, relief valve 127 switches from a relief function to an unloading function and serves as an unloading valve 127. Milliseconds after the maximum pressure setting of relief valve 127 is reached, the pressure stored in accumulator 137 actuates the unloading function of unloading relief valve 127 by automatic establishment of a connection between relief valve 127 and hydraulic power fluid line P. The established connection results in exertion of sufficient pressure from hydraulic power fluid line P upon relief valve 127 to push relief valve 127 to conduction. Any excess of generated fluid flows through unloading valve 127 to the extracted-fluid tank 121 at reduced pressure. Meanwhile, flow-control valve 126 maintains the full system pressure in accumulator 137. As long as the fluid pressure in the fluid discharge line T to accumulator 137 is sufficient to hold unloading valve 127 open, the unloading of the fluid through unloading valve 127 into the extracted-fluid tank 121 continues at reduced pressure.

With the four-way valve 133 controlling the cycling of the extraction, the flow switch 132 and the timer 136 setting the recovery cycle and the unloading relief valve 127 controlling over-pressure, an optimum pumping efficiency is obtained.

Using the above information, the operation, as well as the structure, of the fluid extraction pump assembly 169 are described below.

Structure of the Fluid Extraction Pump

Figure 3A:
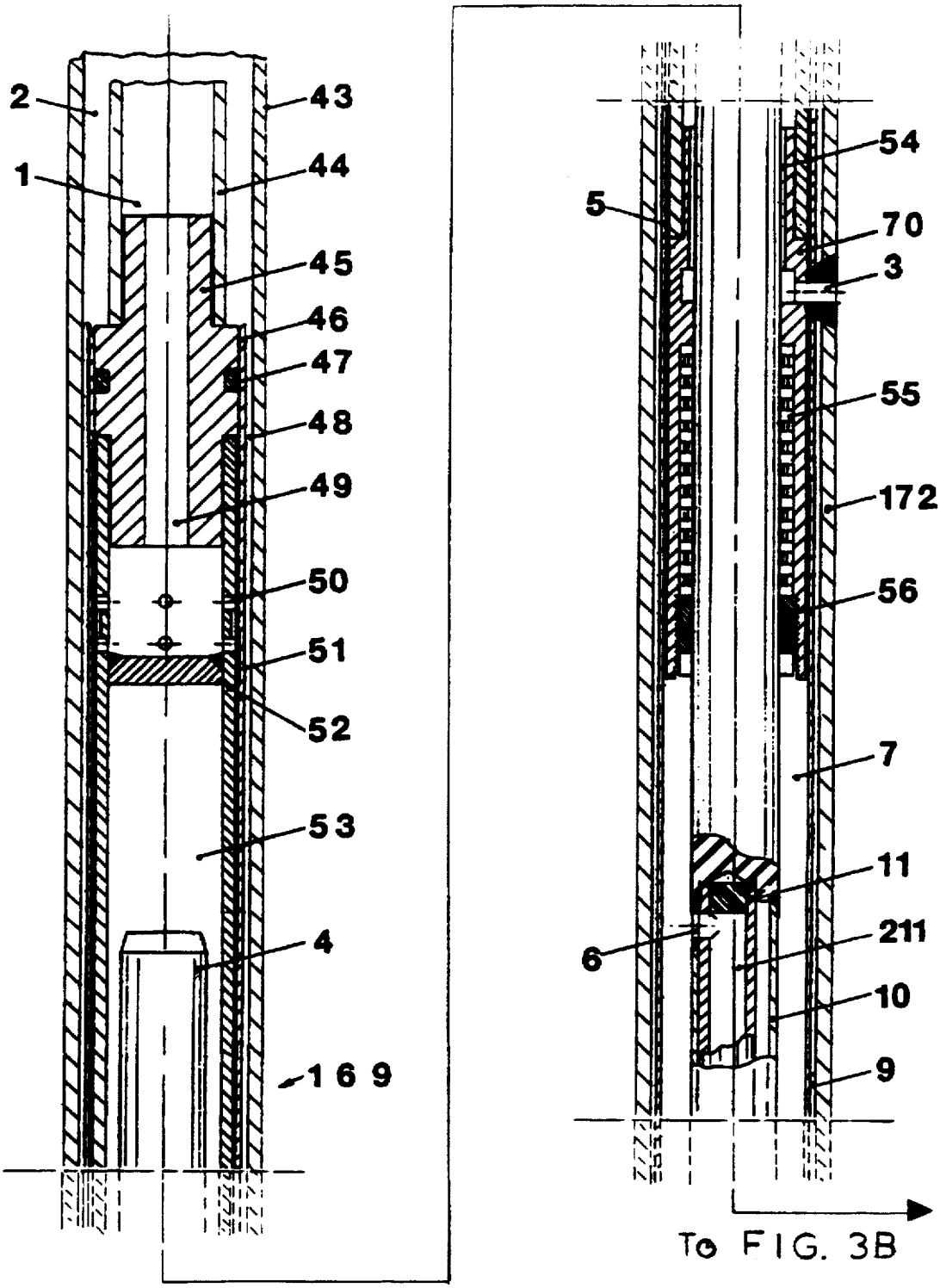
FIG. 3A shows an exploded view of a plurality of manifolds of the fluid extraction pump of FIG. 1.

As shown in FIG. 1, the fluid extraction pump 169 comprises a power piston 172 and a pumping piston 32. In a preferred embodiment, the fluid extraction pump 169 is within tubular casing (as shown in FIG. 3A) and has an outside diameter of less than 45 mm and a well bore diameter of at least 50 mm for application to wells, for extraction of crude oil, water or a mixture thereof, that are at least 3,000 meters deep. The power control system 170, the power piston 172 and the pumping piston 32 operate simultaneously and conjointly as members of a team to pump fluid from wells. Each member of the team includes several major features in its operation that are complementary to the functionality of the other members. A detailed description of the power piston 172 and the pumping piston 32 follows.

The power piston 172 is housed on top of and is coupled with the pumping piston 32. The power piston 172 comprises a number of double-acting, lineal, fluid motor pistons (with two fluid motor pistons being indicated in a version of the power piston 172 shown in FIG. 1 by "67" and "75"). Although there is no maximal limitation on the number of fluid motor pistons of a fluid extraction pump, the chosen number of fluid motor pistons depends on the depth of the well. Fluid motor pistons 67 and 75 must be capable of providing a force to the pumping piston 32 that is sufficient to overcome the hydrostatic pressure of the fluid discharge line T and that is sufficient to inject the pumped fluid out of the well. Optimum applications of fluid motor pistons are as follow: a single fluid motor piston for a depth of about 2,500 meters, two fluid motor pistons for a depth of about 6,000 meters, three fluid motor pistons for a depth between about 10,000 meters and 11,000 meters and four fluid motor pistons for a depth of about 20,000 meters. Using a larger number of fluid motor pistons provides an additional required force to the pumping piston 32 to overcome the hydrostatic pressure of the fluid discharge line T and to inject the pumped fluid to the overhead extracted-fluid tank 121.

The power piston 172 comprises an outer tubular piston rod 10 that extends around and is coaxial with an inner tubular piston rod 11. Piston rod extension 4 sets the upper ending of the inner tubular piston rod 11 and of the outer tubular piston rod 10. As shown in FIG. 3A, tubular member 52 surrounds vented, zero-pressure chamber 53 through which the upper ending of the outer tubular piston rod 10 and of the inner tubular piston rod 11 ascend and descend. A piece permanently joined (e.g. by welding) to tubular member 52 marks the top borderline of the zero-pressure chamber 53. (In the most preferred embodiment of the present invention, parts are permanently joined by welding. The use of the term "welding" throughout the detailed description, however, is not intended to limit the manner of permanent joining.)

Above the zero-pressure chamber 53, conduction passage 49 in adapter 45 follows conduction tube 44 serving as path 1. Adapter 45 is welded to conduction tube 44 and to tubular member 52 but provides a sliding surface for tubular member 46. Static seals 47 isolate tubular member 52 from the hydraulic pressure existing in tubular casing 43. Annular space 51, extending between tubular members 46 and 52, leads via one end through a number of ports 50 to conduction passage 49 and leads via the other end to manifold 7 (refer to FIG. 3A). Conduction passage 48, extending between tubular member 46 and tubular casing 43, connects path 2 via fluid passages 58 to manifold 12.

Figure 3B:
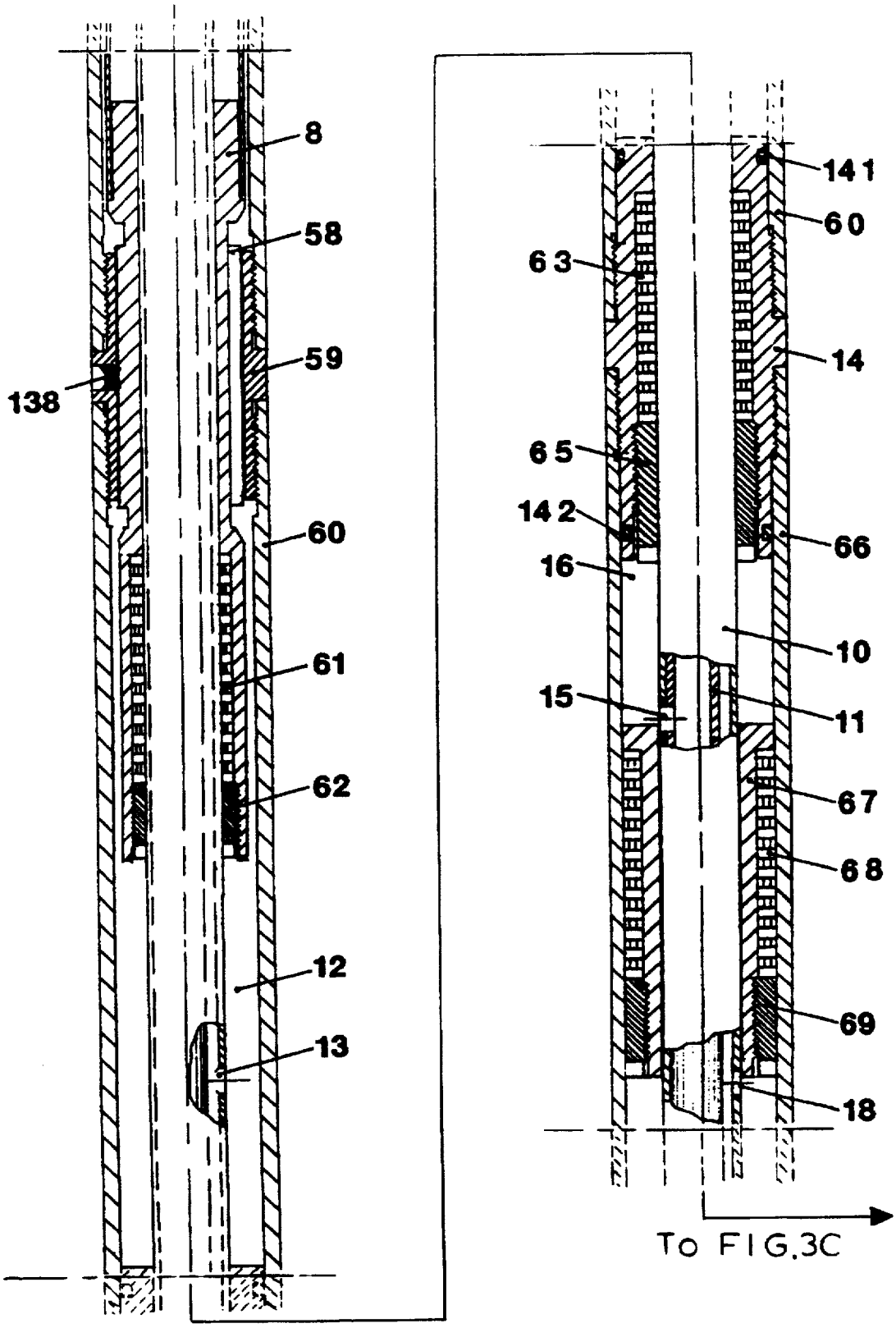
FIG. 3B and FIG. 3C show an exploded view of double-acting, lineal, fluid motor pistons of the power piston of FIG. 1.
Figure 3C:
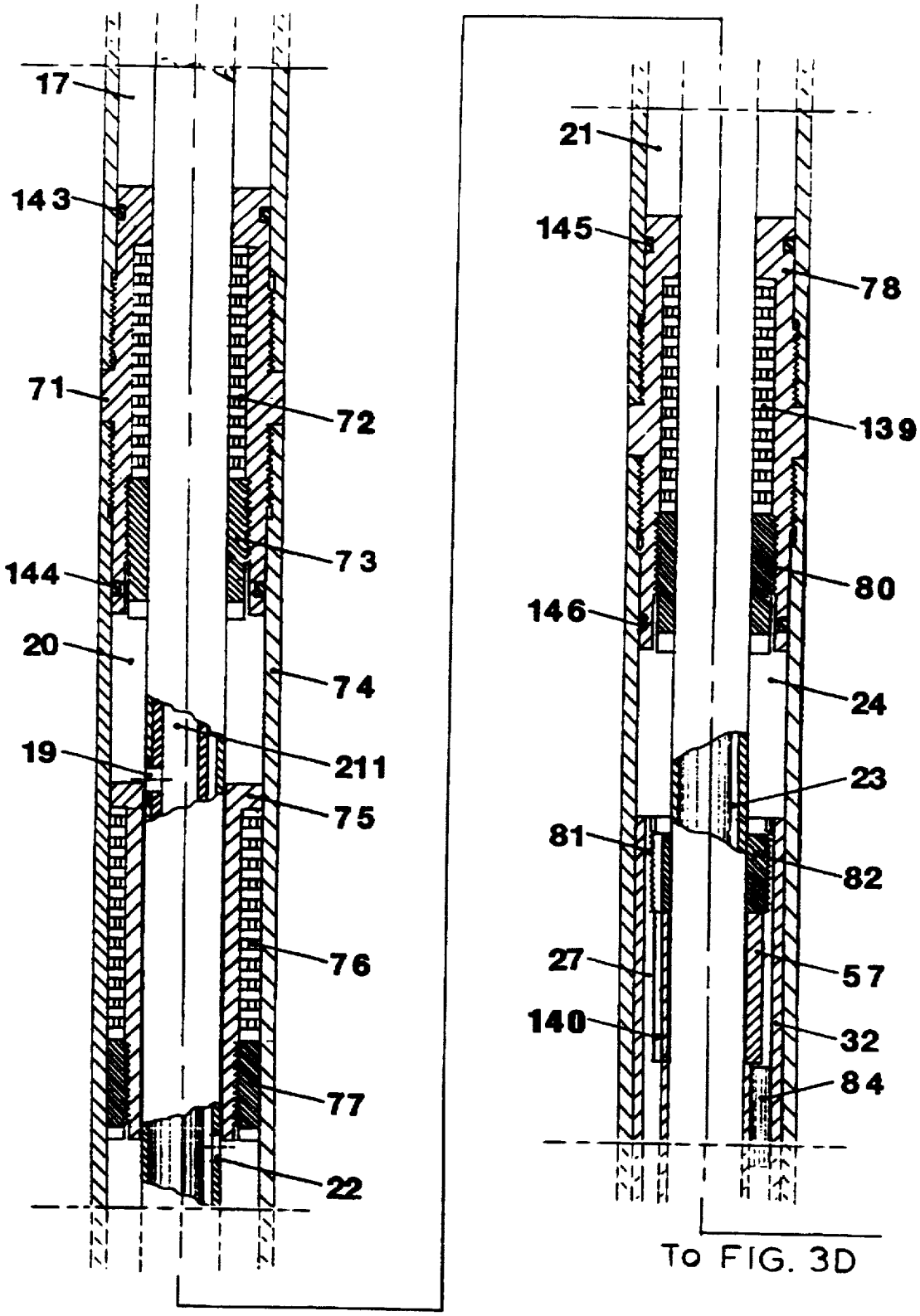

Fluid motor pistons 67 and 75 are welded to the outer tubular piston rod 10 in series but slide on tubular casings 66 and 74, respectively. (The structure of fluid motor pistons 67 and 75 is shown in detail in FIG. 3B and FIG. 3C.) Fluid motor piston 67 has self-adjusting, wear-limited piston seals 68 which are confined by a threaded retainer 69 to fluid motor piston 67. Fluid motor piston 67 moves between pressure chamber 16 and pressure chamber 17 (also indicated on FIG. 1). Port 15 serves as the entrance via inner conduit 211 into pressure chamber 16, while port 18 serves as the entrance via crescent space 23 into pressure chamber 17. As shown in FIG. 3B and FIG. 3C, fluid motor piston 75 has self-adjusting, wear-limited piston seals 76 which are confined by a threaded retainer 77 to fluid motor piston 75. Fluid motor piston 75 moves between pressure chamber 20 and pressure chamber 21. Port 19 serves as the entrance via the inner conduit 211 into pressure chamber 20 and port 22 serves as the entrance via the crescent space 23 into pressure chamber 21.

Complementary to fluid motor pistons 67 and 75 are gland membranes (referred to in FIG. 1 as 70, 8, 14, 71 and 78 in order, with gland membrane 70 establishing the top border of manifold 7 and with gland membrane 78 setting up the bottom border of pressure chamber 21). Gland membranes 70, 8, 14, 71 and 78 divide the power piston 172 into a plurality of sections. A common feature of gland membranes 70, 8, 14, 71 and 78 is their sliding surface that is adjacent and parallel to the outer tubular piston rod 10. A more detailed description of gland membranes 70, 8, 14, 71 and 78 and of their positioning and function follows.

As shown in FIG. 3A, gland seals 55 are housed in gland membrane 70, which is joined by spot-weldments to tubular casing 43 and to tubular member 46. Threaded retainer 56 confine gland seals 55 to gland membrane 70. Spot-weldments leave adequate cross-section of annular space between gland membrane 70 and tubular member 46, as well as between tubular member 46 and tubular casing 43, for conduction of fluid. In order to prevent any transfer of fluid into the vented, zero-pressure chamber 53, gland membrane 70 is welded to tubular member 52 to avoid any space in between gland membrane 70 and tubular member 52. In a preferred embodiment, the spot-weldments are drilled with a number of vent holes 3 (as shown in FIG. 1 and FIG. 3A) to allow flow of air, through clearance 54, into and out of the vented, zero-pressure chamber 53 and to cancel any volume variation due to reciprocations of the upper extension 4 of the outer tubular piston rod 10 (i.e. to relieve the pumping action of piston rod extension 4). However, it should be noted that the number of vent holes 3 could have various positions as long as each vent hole 3 opens into the vented, zero-pressure chamber 53.

Similarly, gland membrane 8 comprises self-adjusting, wear-limited gland seals 61 that are confined by threaded retainer 62 to gland membrane 8 (refer to FIG. 3A). Gland membrane 8 is welded to tubular members 59 and 46. In addition, button welding 138 secures the proper positioning of gland membrane 8 within tubular member 59. Threaded sections of tubular member 59 confine tubular member 59 to tubular casings 43 and 60. Although gland membrane 8 is welded to tubular member 59, a plurality of fluid passages 58 connect conduit 9 to manifold 12.

As demonstrated clearly on FIG. 1, gland membranes 70 and 8 serve as sealing membranes for and set the size of manifold 7. Port 6 (that enclosedly crosses the outer tubular piston rod 10) establishes a path between manifold 7 and the inner conduit 211. On its top, manifold 7 contacts conduit 5 which forms the termination of path 1.

FIG. 3B and FIG. 3C show the structure of gland membranes 14, 71 and 78 in detail. Gland membrane 14 comprises self-adjusting, wear-limited gland seals 63 which are confined by threaded retainer 65 to gland membrane 14. Threaded sections of gland membrane 14 confine gland membrane 14 to tubular casings 60 and 66. Static seals 141 and 142 isolate threaded sections of gland membrane 14 from hydraulic pressure in manifold 12 and in pressure chamber 16 (refer to FIG. 3A, FIG. 3B and FIG. 3C ). Gland membranes 8 and 14 serve as sealing membranes of manifold 12. Path 2 runs by manifold 7 to open, via conduit 9, into manifold 12. Manifold 12 leads through port 13 to outer tubular piston rod 10.

Gland membrane 71 separates fluid motor piston 67 from fluid motor piston 75. Gland membrane 71 comprises self-adjusting, wear-limited, gland seals 72 which are confined by threaded retainer 73 to gland membrane 71. Threaded sections of gland membrane 71 confine gland membrane 71 to tubular casings 66 and 74. Static seals 143 and 144 isolate threaded sections of gland membrane 71 from hydraulic pressure in pressure chamber 17 and in pressure chamber 20. Gland membranes 14 and 71 set the limits of movement of fluid motor piston 67.

Gland membrane 78 comprises self-adjusting, wear-limited, gland seals 139 which are confined by threaded retainer 80 to gland membrane 78. Threaded sections of gland membrane 78 confine gland membrane 78 to tubular casings 74 and 79. Static seals 145 and 146 isolate threaded sections of gland membrane 78 from hydraulic pressures in pressure chamber 21 and pressure chamber 24. Gland membranes 71 and 78 set the limits of movement of fluid motor piston 75. In a preferred embodiment, self-adjusting, wear-limited, gland seals 63, 72, 139, as well as fluid motor pistons 67 and 75, comprise thermoset polymer seals for pumping water from gas-producing wells or are metallic for pumping crude oil from low-producing wells.

Complementary to the power piston 172 is the pumping piston 32. (Please refer to FIG. 1.) The pumping piston 32 has two portions. The upper portion of the pumping piston 32 extends between the bottom of pressure chamber 24, which is the lowest pressure chamber that associates with the inner tubular piston rod 11, and the top of pressure chamber 38, which is the lowest pressure chamber that associates with the outer tubular piston rod 10. The lower portion of the pumping piston 32 extends from bottom of and below the upper portion of the pumping piston 32 and marks the termination of the pumping piston 32. Gland membranes 78 and 39 set the limits of the movement of the upper portion of the pumping piston 32. Pressure chamber 24 separates gland membrane 78 from the pumping piston 32, while pressure chamber 38 separates gland membrane 39 from the pumping piston 32. In addition, plug 97 separates the pumping functions of pressure chamber 24 from pressure chamber 38 (refer to FIGS. 3B–3F).

The lower portion of the pumping piston 32 is a longitudinal, tubular extension 40. (The lower, longitudinal, tubular extension 40, which is also generally known as a snorkel, is referred to as a "suction tube" hereafter.) Retaining collar 109 (shown in FIG. 3D and FIG. 3E) fastens the suction tube 40 to the lower portion of the pumping piston 32 and is locked in place by threaded piston seal adapter 112. A cavity extends along the central section of the suction tube 40, which extends within tubular casing 41. The suction tube 40 comprises a dynamic, reciprocating, bi-directionally self-cleaning, suction filter 42. The suction filter 42 is generically illustrated in FIG. 1 and formally depicted in FIG. 3F. The suction filter 42 reciprocates within tubular casing 41 at a lower section of the fluid extraction pump 169. The suction filter 42 comprises a bi-dimensional filter screen 154, a screen support 156, conduction holes 157, a top cap 152 and a bottom cap 158. A limited, radial side clearance 153 separates the bi-dimensional filter screen 154 from tubular casing 41. The filter screen 154 of the suction filter 42 extends around the screen support 156. The top cap 152 and the bottom cap 158 close the top end and the bottom end, respectively, of the filter screen 154 and of the screen support 156, such that the filter screen 154 and the screen support 156 each extends from the top cap 152 to the bottom cap 158. To avoid suction leakage of unfiltered fluid, the clearance between the top cap 152 and the suction tube 40 is closed with an elastomeric seal 166. In order to prevent displacement of the top cap 152 and of the bottom cap 158, the top cap 152 and the bottom cap 158 are welded to the screen support 156 and, in addition, the bottom cap 158 is confined by threaded sections to the suction tube 40. A lock-nut 159 fastens the suction filter 42 to the suction tube 40. Radial side clearance 167 separates the filter screen 154 from the screen support 156. The screen support 156 has conduction holes 155 through which well fluid flows upon filtration. Conduction holes 157 lead to a cavity that extends along the central section of the suction tube 40. A welded plug 165 closes the lower end of the central cavity of the suction tube 40.

Figure 4:
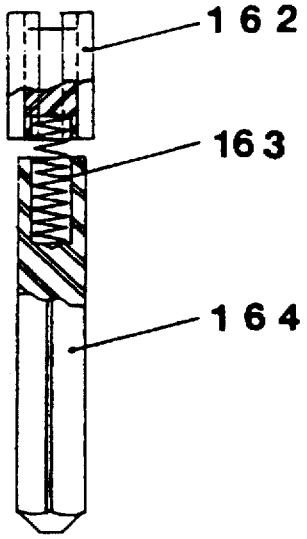
FIG. 4 shows a uni-directional valve to be used with the fluid extraction pump of FIG. 1 for slanted or horizontal wells.

Fluid-flow passages (e.g. channels) run interconnectedly within the pumping piston 32. Poppet-type, uni-directional, fluid-flow control valves 28, 29, 34 and 35 (referred to hereafter as "poppet-type check valves") control flow of well fluid through the fluid-flow passages from suction into to discharge out of the pumping piston 32 (refer to FIG. 1). Poppet-type check valves 28, 29, 34 and 35 are gravity-biased. In steeplyslanted or horizontal wells, poppet-type check valves 28, 29, 34 and 35 are replaced by spring-biased valves 164 which comprise a spring 163 and fluted stops 162 (as shown in FIG. 4). The fluted stops 162 replace anvil stops 88, 93, 100 and 105 used in poppettype check valves 28, 29, 34 and 35, respectively.

Figure 3D:
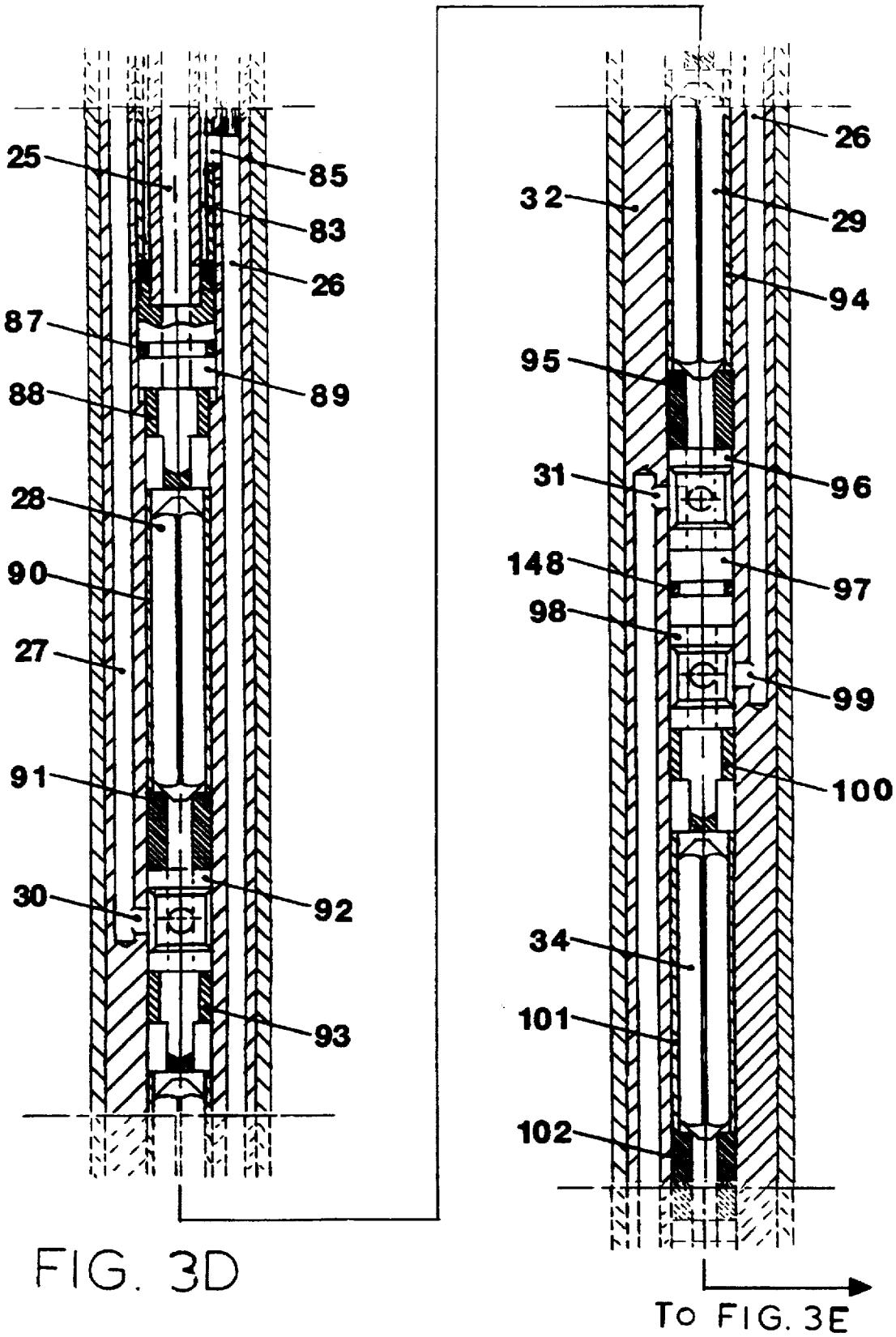
FIG. 3D and FIG. 3E show an exploded view of internal valving and conduits of the pumping piston of FIG. 1.
Figure 3E:
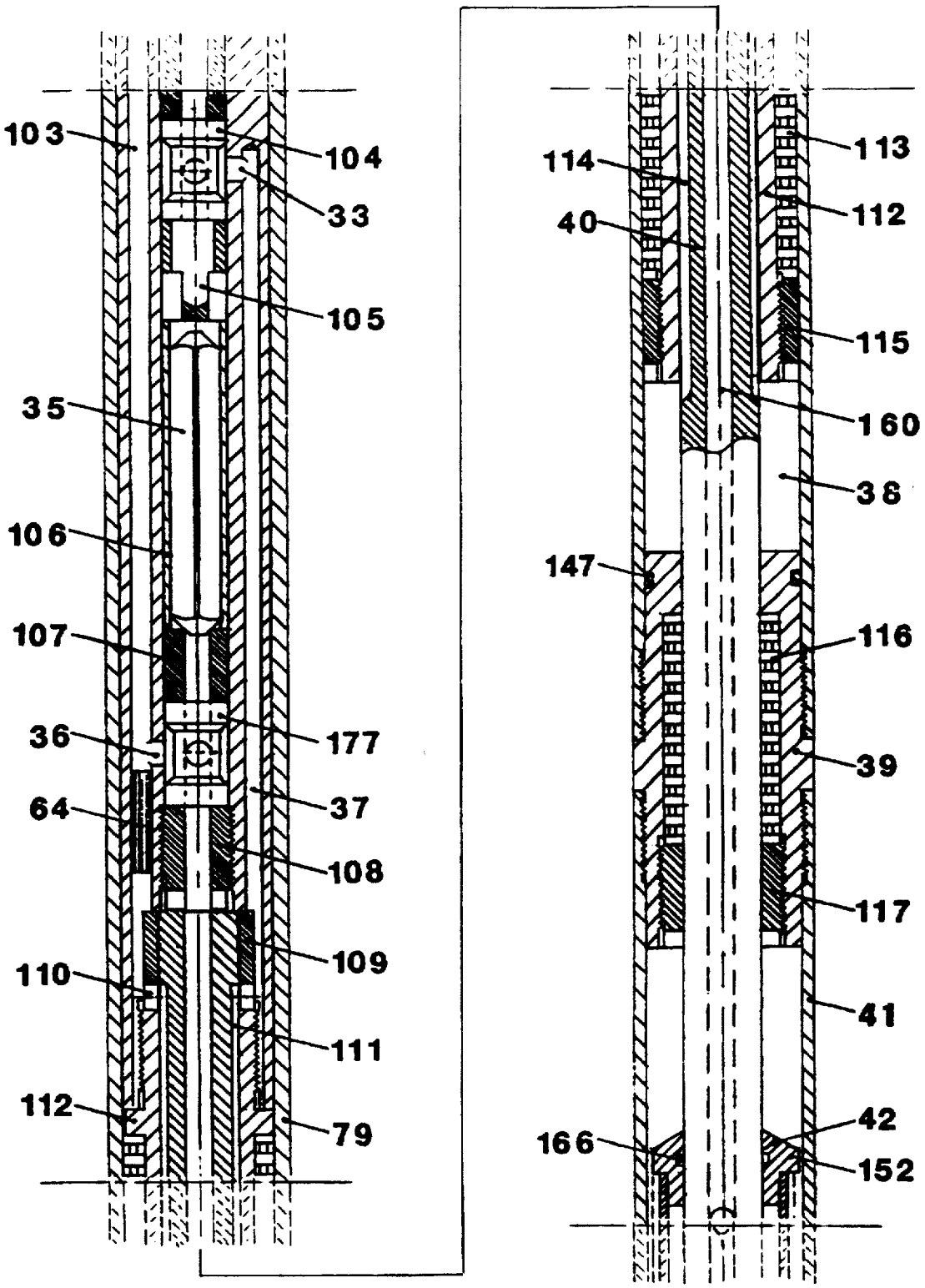
Figure 3F:
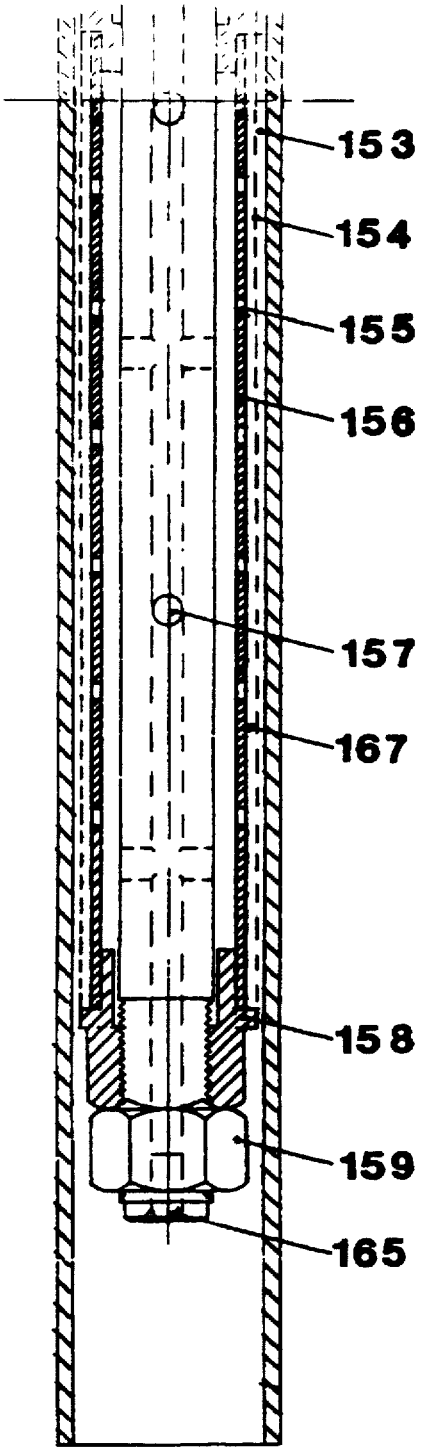
FIG. 3F shows a generic illustration of a suction filter used in the fluid extraction pump of FIG. 1.

As shown in FIG. 1, FIG. 3D and FIG. 3E, poppet-type, unidirectional valves 28, 29, 34 and 35 are positioned in a central cavity in the pumping piston 32 and are interconnected by fluid-flow passages 26, 27, 37 and 103 which provide full-flow passage for the well fluid. The cavity extending along the central section of the suction tube 40 continues, with an interruption by a plug 97 in a portion of the pumping piston 32 between poppet-type check valve 34 and poppet-type check valve 29, through the pumping piston 32. Suction line 160 is a path for the flow of well fluid along the central section of the suction tube 40. Gland membrane 39 marks the bottom end of pressure chamber 38 and joins tubular casing 41 to tubular casing 79 which surrounds pressure chamber 38. Self-adjusting, wear-limited gland seals 116 are confined by threaded retainer 117 to gland membrane 39 (as shown in FIG. 3F). Static seal 147, positioned between threaded sections of gland membrane 39 and hydraulic pressure in pressure chamber 38, isolates threaded sections of gland membrane 39 from hydraulic pressure in pressure chamber 38. At the top of pressure chamber 38, threaded piston seal adapter 112, with self-adjusting, wear-limited gland seals 113 that are retained by threaded retainer 115 to piston seal adapter 112, surround a portion of the suction tube 40. Slots 111 and 114 extend between threaded piston seal adapter 112 and the suction tube 40. With threaded piston seal adapter 112 blocking fluid-flow passage 37, port 110 connects fluid-flow passage 37 to slots 111 and 114. Positioned above port 110 is retaining collar 109 which is below threaded hollow plug 108. Suction tube 40 is fastened with retaining collar 109 to the upper portion of the pumping piston 32 through threaded piston seal adapter 112. Threaded hollow plug 108 retains, under axial compression, all internal components of valving (comprising poppet-type check valves 28, 29, 34 and 35 and the components related to the poppet-type check valves 28, 29, 34 and 35) up to and against spacer 89 (refer to FIG. 3D and FIG. 3E). Spacer 89 also serves as the lower end piece of the outer tubular piston rod 10 which is fastened in place by collar 57 and threaded fastener 82. Threaded fastener 82 confines pumping piston 32 through collar 57 fastened upon the outer tubular piston rod 10. (Please refer to FIG. 3B and FIG. 3C.)

The central cavity in the pumping piston 32 extends from conduction holes 157 through diverter connection 177 and through poppet-type check valves 34 and 35. The central cavity disconnects at plug 97, restarts at diverter connection 96 and continues upwards through the pumping piston 32 to the inner conduit 211. Fluid-flow passages that pass through diverter connection 177 come into contact with fluid-flow passage 103 through diverter port 36. (Please refer to FIG. 3D and FIG. 3E.) Plug 64 separates fluid-flow passage 103 from any lower fluid-flow passages which do not pass through diverter connection 177. Diverter connection 177 neighbors valve seat 107 which extends along a plurality of cordial, circular segment spaces around poppet-type check valve 35, which is seated on valve seat 107 and is positioned within spacer sleeve 106. Above poppet-type check valve 35, side ports of anvil stop 105 lead to diverter connection 104. Diverter port 33 provides a connection between diverter connection 104 and fluid-flow passage 37 and neighbors the uppermost ending of fluid-flow passage 37. In addition to serving as a diverting element, diverter connection 104 enables upwardly-flowing fluid from pressure chamber 38 to join the central cavity. The upwardly-flowing fluid leaving diverter connection 104 passes through valve seat 102 towards poppet-type check valve 34. Poppet-type check valve 34 is seated on valve seat 102 and is positioned within spacer sleeve 101. Side ports of anvil stop 100 provide connections between poppet-type check valve 34 and diverter port 99. Diverter port 99 joins diverter connection 98 to fluid-flow passage 26. Plug 97 separates diverter connection 98 from diverter connection 96. In addition, static seal 148 isolates diverter connection 98 from hydraulic pressures in diverter connection 96 and, in turn, diverter connection 96 from hydraulic pressures in diverter connection 98. At its uppermost ending, fluid-flow passage 103 reaches diverter port 31 which neighbors diverter connection 96. The central cavity in the pumping piston 32 also extends from diverter connection 96 to the ending of the inner conduit 211. In contrast, fluid-flow passage 26 continues through crescent space 23. The central cavity in pumping piston 32 runs through valve seat 95 which seats poppet-type check valve 29. Poppet-type check valve 29 is positioned within spacer sleeve 94 and, along with a plurality of cordial, circular segment spaces, forms a base for anvil stop 93. Above and attached to anvil stop 93, as well as side ports of anvil stop 93, is diverter connection 92. Diverter port 30 connects to fluid-flow passage 27 which serves as a passage for fluid flowing between the central cavity of the pumping piston 32 and pressure chamber 24. Communication between diverter connection 92 and fluid-flow passage 27 is via diverter port 30. Diverter connection 92 neighbors valve seat 91 through which a path for flow of fluid to poppet-type check valve 28 exists. Valve seat 91 supports poppet-type check valve 28 which forms a plurality of cordial, circular segment spaces and is housed in spacer sleeve 90. Side ports of anvil stop 88 form a liaison between poppet-type check valve 28 and spacer 89. Static seal 87 isolates poppet-type check valve 28 from hydraulic pressures in the inner conduit 211. The path through spacer 89 leads via fluid-flow passage 25 to the inner conduit 211. Fluid-flow passage 26, at its uppermost portion, is connected via port 85 to conduit 83 which leads to crescent space 23. In order to direct a maximal flow of the fluid to crescent space 23, fluid-flow passage 26 is obstructed at its top end with plug 84. (Please refer to FIG. 3B, FIG. 3C, FIG. 3D, and FIG. 3E.). Above plug 84, threaded fastener 82, which retains tubular member 57, fastens the top portion of the pumping piston 32 to the outer tubular piston rod 10. Grooves 81 and 140 are intended to provide full conduction through fluid-flow passage 27 past tubular member 57 and threaded fastener 82.

With fluid-flow passage 25 establishing a connection between the inner tubular piston rod 11 and the pumping piston 32 and with fluid-flow passage 26 establishing a connection between the outer tubular piston rod 10 and the pumping piston 32, the pumping piston 32 and the power piston 172 serve conjointly as the double-acting, deep-well, fluid extraction pump assembly 169.

Operation of the Fluid Extraction Pump Assembly

A detailed description of the operation of the fluid extraction pump assembly 169 follows. The description is not intended to limit the operation of different types of fluid extraction pump assemblies and is, rather, based upon the above analyzed preferred embodiment of the fluid extraction pump 169. The operation of the power control system 170 itself is explained above in detail. In this section, the unified operation of the power piston 172 and the pumping piston 32, along with the complementary role of the power control system 170 in this unified operation, are presented.

The operation of the fluid extraction pump assembly 169 is divided into half-cycles, too. The position of the four-way valve 133 determines switchings of the half-cycles of the fluid extraction pump assembly 169 as well and, thus, the same half-cycles apply. In the first suction half-cycle, pressurized fluid enters the fluid extraction pump assembly 169 through port A while port B directs return fluid to fluid discharge line T. In the second suction half-cycle, hydraulic power fluid line P leads to port B while port A directs return fluid to fluid discharge line T. (Please refer to FIG. 2.) Therefore, each time pressurized fluid passes into the fluid extraction pump assembly 169 through one path, pumped fluid flows out of the fluid extraction pump assembly 169 through the other path.

In the first suction half-cycle, fluid flows into the power piston 172 via path 2. The pressurized fluid enters manifold 12 through conduit 9 and, then, enters crescent space 23 through port 13. While flowing through the crescent space 23, the pressurized fluid enters pressure chamber 17 through port 18, exerting an upward force or an up stroke on fluid motor piston 67. The pressurized fluid in the outer tubular piston rod 10 also enters pressure chamber 21 through port 22, exerting an upward force on fluid motor piston 75. (Please refer to FIG. 1.) The additive upward forces, that are exerted on fluid motor pistons 67 and 75, lift fluid motor pistons 67 and 75 and the power piston 172, as well as the pumping piston 32.

The pumping piston 32 is reciprocated by fluid motor pistons 67 and 75 via the outer tubular piston rod 10 and via the inner tubular piston rod 11. With the pressurized fluid flowing through the outer tubular piston rod 10 and through the inner tubular piston rod 11, the faces of fluid motor pistons 67 and 75 are subject to the hydrostatic fluid column pressure of paths 1 and 2. The reaction forces of hydrostatic pressure and over-pressure are resisted by gland membranes 78, 71 and 14. For example, in a well of 3,000 meters deep, when paths 1 and 2 are filled with water, a pressure of 300 $kg/cm^2$ is developed on the faces of fluid motor pistons 67 and 75. However, with an equal pressure being exerted on opposite faces of each fluid motor piston 67 and 75 individually, hydrostatic forces acting on each pair of opposite faces are balanced and canceled, and only the over-pressure generated by the hydraulic pump 123, directed selectively to the upper or lower faces of fluid motor pistons 67 and 75, transmits the force to the pumping piston 32 through the outer tubular piston rod 10 and the inner tubular piston rod 11.

Hand-in-hand with the power piston 172, the pumping piston 32 operates to pump the well fluid. During the up-stroke of the pumping piston 32, the pressure in pressure chamber 38 is reduced. The reduced pressure of pressure chamber 38 results in the flow of well fluid into pressure chamber 38 through the suction filter 42 in the tubular casing 41 and through the cavity that extends along the central section of the suction tube 40. The well fluid passes diverter connection 177 and flows through valve seat 107 and via cordial, circular segment spaces of poppet-type check valve 35 housed within spacer sleeve 106. Upon leaving side ports of anvil stop 105, the well fluid passes diverter connection 104 and diverter port 33 and enters fluid-flow passage 37. Before discharging through fluid-flow passage 37 into pressure chamber 38, the fluid passes through port 110 and slots 111 and 114. Poppet-type check valve 34 opposes the interaction of the upwardly-rushing well fluid, that passes through poppet-type check valve 35 before entering fluid-flow passage 37, with the downwardly-moving fluid, that descends through crescent space 23.

Meanwhile, during the up-stroke, pressure is exerted by the rising pumping piston 32 on previously-collected pumped fluid existing in pressure chamber 24. This upward pressure on pressure chamber 24 results in the compression of and the expulsion of the well fluid previously collected in pressure chamber 24. The expelled fluid leaves pressure chamber 24 via fluid-flow passage 27 and passes through diverter port 30. In order to oppose return flows and/or unwanted flows through diverter connection 92, poppet-type check valve 29 is used. Poppet-type check valve 29, that is closed by the fluid pressure of the pumped fluid, opposes the interaction of the well fluid that exits pressure chamber 24 with any upwardly-rushing well fluid that has diverted at diverter connection 96. Thus, poppet-type check valve 29 contributes to the transfer of a maximal amount of fluid from pressure chamber 24 to the inner conduit 211. The well fluid passes diverter connection 92 and flows through valve seat 91 and via cordial, circular segment spaces of poppet-type check valve 28 housed within spacer sleeve 90. Then, the fluid flows through side ports of anvil stop 88 which limits the up-stroke of poppet-type check valve 28 within spacer 89. Upon passing spacer 89 and static seal 87, the fluid enters via fluid-flow passage 25 into the inner conduit 211. The exertion of an upward pressure on pressure chamber 24 is accompanied by the exertion of an upward pressure by fluid motor pistons 67 and 75 on the hydraulic power fluid in pressure chambers 16 and 20. The well fluid from pressure chamber 24 and the fluid from pressure chambers 16 and 20, jointly flow through path 1. The mixture of the fluids from pressure chambers 24, 16 and 20 leaves the power piston 172 via the inner conduit 211 and path 1. The fluid mixture leaves the inner conduit 211 through port 6, which leads to manifold 7, and passes out of manifold 7 through conduit 5 and port 50. The expelled fluid passes through port B and, then, through the four-way valve 133 to enter fluid discharge line T. After adjustable time delay, the four-way valve 133 shifts to the right.

Flow of fluid via path 1 through conduit 5, manifold 7, port 6 and the inner conduit 211 yields a down-stroke on fluid motor pistons 67 and 75. Pressurized fluid entering through port 15 pushes fluid motor piston 67 downwards and pressurized fluid entering through port 19 pushes fluid motor piston 75 downwards. The downward pressure on fluid motor pistons 67 and 75 results in exertion of a downward pressure by the pumping piston 32 on the well fluid in pressure chamber 38. As explained above, the well fluid that exists in pressure chamber 38 at this time has collected during the previous suction half-cycle, upon passing poppet-type check valve 35. Due to the exerted downward pressure, the well fluid in pressure chamber 38 rushes out through slots 114 and 111 and enters fluid-flow passage 37 via port 110. The well fluid reaches diverter port 33 and diverter connection 104 to discharge into the cavity along the central section of the pumping piston 32. The well fluid flows through valve seat 102 and via circular segment spaces of poppet-type check valve 34 housed within spacer sleeve 101. The fluid from pressure chamber 38 then passes poppet-type check valve 34 through side ports of anvil stop 100 and, via diverter connection 98 and diverter port 99, enters into fluid-flow passage 26. Fluid-flow passage 26 is obstructed at its top end by plug 84. Thus, the fluid enters, through port 85 (which is the sole exit on the uppermost part of fluid-flow passage 26), conduit 83 which leads to crescent space 23. The well fluid from conduit 83 and the fluid from pressure chambers 17 and 21 jointly exit the outer tubular piston rod 10 through port 13, manifold 12, conduit 9 and conductor 48. The expelled fluid passes, via path 2, through port A to enter fluid discharge line T. After adjustable time delay, the four-way valve 133 shifts to the left.

During the down-stroke of the pumping piston 32, pressure chamber 24 is subject to reduced pressure. The reduced pressure in pressure chamber 24 results in the flow of well fluid through the suction filter 42 into the cavity that extends along the central section of the suction tube 40. The well fluid flows through the cavity along the central section of the suction tube 40 and through slots 114 and 111 until reaching diverter connection 177. Diverter port 36 allows passage of the well fluid into fluid-flow passage 103 which leads through diverter port 31 to diverter connection 96. Diverter connection 96 diverts the fluid into the cavity along the central section of the pumping piston 32. Upon flowing through valve seat 95 via circular segment spaces of poppet-type check valve 29 housed within spacer sleeve 94, the well fluid moves through anvil stop 93, diverter connection 92 and diverter port 30 before reaching fluid-flow passage 27. Fluidflow passage 27 leads to pressure chamber 24, wherein the well fluid discharges, to be stored for leaving the fluid extraction pump assembly 169 during the following suction half-cycle. During the flow of the well fluid into pressure chamber 24, check valve 28 is firmly seated upon valve seat 91 by the hydrostatic fluid pressure in path 2.

Poppet-type check valve 28 opposes the interaction of the rushing well fluid that is passing through poppet-type check valve 29, before entering fluid-flow passage 27, with the fluid that is descending through the inner conduit 211. Collision of the fluid of the inner conduit 211 with the well fluid heading towards fluid-flow passage 27 is avoided by poppet-type check valve 28. Poppet-type check valve 35 opposes the interaction of the well fluid that leaves pressure chamber 38 with the fluid that enters the fluid extraction pump assembly 169 through the suction tube 40.

The flow of well fluid through the suction filter 42 into pressure chambers 24 and 38 is propelled by the atmospheric pressure, as well as by the slight hydrostatic well-fluid pressure. High-velocity well fluid that is drawn through the suction filter 42 passes through the limited radial side clearance 153 between the bi-dimensional filter screen 154 and the tubular casing 41. On each suction half-cycle, the well fluid flushes through the radial side clearance 153 and, then, through the filter screen 154 of the suction filter 42. When the suction tube 40 elevates, the upward movement of the suction filter 42 reciprocates a reversed, high-velocity, pressurized flow of the well fluid through the radial side clearance 153. While flushing through the radial side clearance 153, a portion of the high-velocity well fluid carries away the particles (e.g. sand particles) that, being larger than the openings of the filter screen 154, have been loosely deposited on the filter screen 154. A comparable flushing action of the filter screen 154 by upward, pressurized, high-velocity fluid flow occurs during each down-stroke of the filter screen 154. The downward movement of the filter screen 154 causes an upward, high-velocity, pressurized flow of the well fluid through the radial side clearance 153, dislodging any remaining particles on the filter screen 154. Thus, the pressurized, high-velocity well fluid flushes the filter screen 154 during each up-stroke and down-stroke of the filter screen 154. The continuous removal of the particles that are loosely deposited on the filter screen 154 prevents the build-up of a filter cake on the filter screen 154 and renovates the efficiency of the filter screen 154. The minimal pick-up of particles and precipitation of minerals on the inner surface of the filter screen 154 demonstrates the importance of equalized fluid flow during fluid extraction by the fluid extraction pump assembly 169. The removed particles eventually settle at the bottom of the well for periodical collection of the settled sand. Ideally, the fluid extraction pump assembly 169 should pump continuously to facilitate control of the well production with minimal variation of pumping level and with minimum, or no dwell, well-recovery periods. Matched inflow and outflow results in the development of a minimum pressure gradient across the filter screen 154, minimizing a precipitation of scale in the inner surface of the filter screen 154. The remaining flushing well fluid passes through the filter screen 154. The filtered well fluid passes through a plurality of radial holes 155 in the screen support 156 into the cavity extending along the central section of the suction tube 40. It is through this cavity that the filtered flushing well fluid passes toward pressure chamber 24 on one suction half-cycle and toward pressure chamber 38 on the other suction half-cycle, as presented above.

Certain objects are set forth above and made apparent from the foregoing description, drawings and examples. However, since certain changes may be made in the above description, drawings and examples without departing from the scope of the invention, it is intended that all matters contained in the foregoing description, drawings and examples shall be interpreted as illustrative only of the principles of the invention and not in a limiting sense. With respect to the above description and examples then, it is to be realized that any descriptions, drawings and examples deemed readily apparent and obvious to one skilled in the art and all equivalent relationships to those stated in the examples and described in the specification or illustrated in the drawings are intended to be encompassed by the present invention.

Further, since numerous modifications and changes will readily occur to those skilled in the art, it is not desired to limit the invention to the exact construction and operation shown and described, and accordingly, all suitable modifications and equivalents may be resorted to, falling within the scope of the invention. It is also to be understood that the following claims are intended to cover all of the generic and specific features of the invention herein described, and all statements of the scope of the invention which, as a matter of language, might be said to fall in between.

What is claimed as invention is:

1. A double-acting, deep-well fluid extraction pump assembly, for producing fluid from a formation located downhole in a borehole, comprising:

(a) a power piston having a tubular casing and housing an outer tubular piston rod, an inner tubular piston rod, a number of double-acting, lineal, fluid motor pistons and gland membranes, with the outer tubular piston rod coaxially extending and forming a crescent space around the inner tubular piston rod that provides an inner conduit, with the gland membranes being in a permanently-joined relationship with the tubular casing and in a slidable relationship with the outer tubular piston rod and dividing the power piston into pressure chambers and into one manifold opening into the inner conduit and another manifold opening into the crescent space, with each fluid motor piston being in a permanently-joined relationship with the outer tubular piston rod and in a slidable relationship with the tubular casing, sliding upwards through an upper pressure chamber of the power piston that is topped by an upper gland membrane and connected to the inner conduit through a port and sliding downwards through a lower pressure chamber of the power piston that is bottomed by a lower gland membrane and that is connected to the crescent space through a port, thereby resulting in switching of entrance path of hydraulic power fluid and complementary switching of exit path of pumped fluid between a first path connected to one manifold and a second path connected to the other manifold; and (b) a pumping piston being housed below and coupled with the power piston, being divided into an upper portion and a lower portion that houses a suction tube and having a tubular casing in a slidable relationship with the upper portion that houses gravity-biased poppet-type check valves interconnected by fluid-flow passages and that extends between an upper pressure chamber of the power piston and a lower pressure chamber of the power piston, with the upper pressure chamber of the power piston being topped by the lowest gland membrane of the power piston and with the lower pressure chamber of the power piston being bottomed by a gland membrane which is in a permanently-joined relationship with the tubular casing of and is in a slidable relationship with the lower portion of the pumping piston;

whereby in each upstroke resulting from exertion of upward pressure under each fluid motor piston by hydraulic power fluid flowing through the crescent space, pumped fluid flows through the suction tube into the lower pressure chamber of the pumping piston and previously-collected pumped fluid in the upper pressure chamber of the pumping piston and in the upper pressure chamber of each fluid motor piston flow through the inner conduit and the associated path out of the fluid extraction pump assembly; and whereby in each downstroke resulting from exertion of downward pressure above each fluid motor piston by hydraulic power fluid flowing through the inner conduit, pumped fluid flows through the suction tube into the upper pressure chamber of the pumping piston and previously-collected pumped fluid in the lower pressure chamber of the pumping piston and in the lower pressure chamber of each fluid motor piston flow through the crescent space and the associated path out of the fluid extraction pump assembly.

2. The fluid extraction pump assembly of claim 1 wherein consecutive upstroke-downstroke switchings are controlled by a power control system in which a four-way, directional, flow-control valve leads hydraulic power fluid towards the crescent space in a parallel-flow pattern of porting and towards the inner conduit in a crossed-flow pattern of porting and leads pumped fluid to an extracted-fluid tank through a flow switch which controls a timer adjusted to interrupt the operation of a drive motor of a hydraulic pump for a set period of time, with the start of the drive motor recommencing operation of the hydraulic pump which leads fluid from the extracted fluid tank through a number of suction filters, a pressure filter and a flow-control valve to an accumulator, with an unloading relief valve providing a connection to the extracted-fluid tank upon receiving an amount of pressure via a hydraulic power fluid line from the accumulator that is sufficient to push the relief valve to unload in order to control pressure waves traveling through the hydraulic power fluid line toward a flow-control valve that is positioned between the accumulator and the four-way valve.

3. The fluid extraction pump assembly of claim 2 wherein, during the flow of hydraulic power fluid to the power piston, a fraction of the hydraulic power fluid leaving the four-way valve diverts to one side of the four-way valve toward a flow-control valve, an accumulator and a check valve which blocks the flow of fluid, except through the flow-control valve, to the accumulator, until the accumulator contains an amount of fluid that exerts sufficient force for depressurizing any excess pressure on the first side and for shifting the four-way valve to the opposite side, resulting in discharge of hydraulic power fluid previously diverted to the opposite side of the four-way valve.

4. The fluid extraction pump assembly of claim 1 wherein a vented zero-pressure chamber extending above the uppermost gland membrane serves as an upper border for ascents of the outer tubular piston rod.

5. The fluid extraction pump assembly of claim 1 wherein the upper portion of the pumping piston slides between the lowest gland membrane of the power piston and the gland membrane positioned below the lower pressure chamber of the pumping piston.

6. The fluid extraction pump assembly of claim 1 wherein the suction tube of the pumping piston has a dynamic, reciprocating, bi-directionally self-cleaning, suction filter comprising a screen support with conduction holes through which well fluid flows upon filtration and a bi-dimensional filter screen that is separated by a limited, radial side clearance from a surrounding tubular casing and that extends around the screen support, so that each upward, as well as each downward, movement of the suction filter reciprocate a reversed, high-velocity, pressurized flow of well fluid through the radial side clearance and through the filter screen, with a portion of the high-velocity well fluid dislodging any particles that are loosely deposited on the filter screen.

7. The fluid extraction pump assembly of claim 1 wherein the gravity-biased poppet-type check valves are arranged interconnectedly, in a central cavity extending along the upper portion of the pumping piston except for an interruption by a plug which separates pumping functions of the upper pressure chamber from pumping functions of the lower pressure chamber of the pumping piston, so that:

during the upstroke, well fluid flows through a bottom poppet-type check valve below the plug to the lower pressure chamber but a top poppet-type check valve below the plug prevents flow of hydraulic power fluid to the lower pressure chamber of the power piston, while well fluid previously collected in the upper pressure chamber of the power piston undergoes compression and flows through a top poppet-type check valve above the plug toward the inner conduit but a bottom poppet-type check valve above the plug prevents downward flow of the well fluid from and upward flow of the well fluid to the upper pressure chamber of the power piston; and during the downstroke, well fluid flows to the upper pressure chamber of the power piston through the bottom poppet-type check valve above the plug but the top poppet-type check valve above the plug prevents flow of hydraulic power fluid to the upper pressure chamber of the power piston, while the bottom poppet-type check valve below the plug prevents upward flow of well fluid to and downward flow of well fluid from the lower pressure chamber of the power piston and the top poppet-type check valve below the plug permits flow of well fluid stored in the lower pressure chamber of the power piston toward the crescent space.

8. A double-acting, deep-well fluid extraction pump assembly, comprising a power piston within which an inner conduit, a crescent space, pressure chambers and two manifolds are formed and a pumping piston through which interconnected fluid flow passages extend, set up by:

(a) an inner tubular piston rod within which the inner conduit extends and around which the crescent space is formed by an outer tubular piston rod, a pair of gland membranes establishing horizontal borders of each manifold through which hydraulic power fluid enters and consecutively pumped fluid exits, and a number of double-acting, lineal, fluid motor pistons individually positioned between a pair of gland membranes to provide an upper pressure chamber of the power piston with a port through which fluid flows from and to the inner conduit and a lower pressure chamber of the power piston with a port through which fluid flows from and to the crescent space and to impart reciprocal fluid flow to the inner conduit and to the crescent space during upward and downward sliding movements of the fluid motor piston; and (b) a number of gravity-biased poppet-type check valves axially aligned in a central cavity of an upper portion of the pumping piston, except for an interruption by a plug, and interconnected by fluid-flow passages including a first flow path, via which fluid flows from a suction tube through a bottommost poppet-type check valve to a lower pressure chamber of the power piston, formed between bottom of the upper portion of the pumping piston and a gland membrane, and then through a higher poppet-type check valve to the crescent space, and a second flow path, via which fluid flows from the suction tube through a poppet-type check valve that is above the plug to an upper pressure chamber of the power piston, formed between top of the upper portion of the pumping piston and the lowest gland membrane of the power piston, and then through an uppermost poppet-type check valve to the inner conduit;

whereby when hydraulic power fluid flows through the crescent space and under the fluid motor pistons and forces the power piston and the pumping piston to move upwards, pumped fluid flows into the lower pressure chamber of the power piston and forces the pumping piston to move upwards and to exert pressure on the previously-stored pumped fluid of the upper pressure chamber of the power piston and thereby pumped fluid exits the pumping piston via the inner conduit;

whereby when hydraulic power fluid flows through the inner conduit and over the fluid motor pistons and forces the power piston and the pumping piston to move downwards, pumped fluid flows into the upper pressure chamber of the power piston and forces the pumping piston to move downwards and to exert pressure on the previously-stored pumped fluid of the lower pressure chamber of the power piston and thereby pumped fluid exits the power piston via the crescent space; and whereby flow of pumped fluid to the inner conduit is separated from flow of pumped fluid to the crescent space.

9. The fluid extraction pump assembly of claim 8 wherein consecutive upstroke-downstroke switchings are controlled by a power control system in which, upon passing a four-way, directional, flow-control valve, hydraulic power fluid flows toward the crescent space in a parallel-flow pattern of porting and toward the inner conduit in a crossed-flow pattern of porting and pumped fluid flows toward an extracted-fluid tank through a flow switch which controls a timer adjusted to interrupt the operation of a drive motor of a hydraulic pump for a set period of time, and upon the start of the drive motor of the hydraulic pump, fluid flows from the extracted fluid tank through a number of suction filters, a pressure filter and a flow-control valve to an accumulator until sufficient pressure transfers from the accumulator via the hydraulic power fluid line to adjust an unloading relief valve to set up a path via which any excess hydraulic power fluid flows to the extracted-fluid tank;

whereby pressure waves traveling through and maximum pressure in the power control system are controlled.

10. The fluid extraction pump assembly of claim 9 wherein, during the flow of hydraulic power fluid to the power piston, a fraction of the hydraulic power fluid leaving the four-way valve diverts to one side of the four-way valve toward a flow-control valve, an accumulator and a check valve which blocks the flow of fluid, except through the flow-control valve, to the accumulator, until the accumulator contains an amount of fluid that provides sufficient pressure to shift the four-way valve to the opposite side wherefrom hydraulic power fluid, previously diverted to the opposite side of the four-way valve, flows out.

11. The fluid extraction pump assembly of claim 8 wherein well fluid flows via a limited, radial side clearance extending between a bi-dimensional filter screen of a dynamic, reciprocating, bi-directionally self-cleaning, suction filter of the suction tube and a surrounding tubular casing and, then, flows through conduction holes of a screen support holding the suction filter, so that high-velocity, pressurized well fluid flows through the radial side clearance in reverse directions during upward and downward movements of the suction filter and a portion of the high-velocity well fluid dislodges any particles that are loosely deposited on the filter screen.

12. The fluid extraction pump assembly of claim 8 wherein pumped well fluid consecutively flows, via the interconnected fluid flow passages of the pumping piston, to the inner conduit and the crescent space as follows:

during upstrokes, well fluid flows through a bottom poppet-type check valve below the plug to the lower pressure chamber of the power piston but hydraulic power fluid is prevented by a top poppet-type check valve below the plug to flow to the lower pressure chamber of the power piston, while well fluid previously collected in the upper pressure chamber of the power piston undergoes compression and flows through a top poppet-type check valve above the plug toward the inner conduit but well fluid is prevented by a bottom poppet-type check valve above the plug to flow downwardly from and upwardly to the upper pressure chamber of the power piston; and during downstrokes, well fluid flows through the bottom poppet-type check valve above the plug to the upper pressure chamber of the power piston but hydraulic power fluid is prevented by the top poppet-type check valve above the plug to flow to the upper pressure chamber of the power piston, while well fluid previously collected in the lower pressure chamber of the power piston undergoes compression and flows through the top poppet-type check valve below the plug toward the crescent space but well fluid is prevented by the bottom poppet-type check valve below the plug to flow upwardly to and downwardly from the lower pressure chamber of the power piston.

13. A double-acting, deep-well fluid extraction pump comprising:

(a) a power piston having a tubular casing and housing an inner tubular piston rod providing an inner conduit, an outer tubular piston rod coaxially extending around and being separated by a crescent space from the inner tubular piston rod, gland membranes being permanently joined to the tubular casing and positioned in a slidable relationship with the outer tubular piston rod and dividing the power piston into pressure chambers and into a manifold that is connected via a path to a power control system and via a port to the inner conduit and another manifold that is connected via a path to the power control system and via a port to the crescent space, and a number of double-acting, lineal, fluid motor pistons permanently-joined in series to the outer tubular piston rod but positioned in a slidable relationship with the tubular casing, with each fluid motor piston being positioned between an upper pressure chamber of the power piston, topped by an upper gland membrane and connected to the inner conduit through a port, and a lower pressure chamber of the power piston bottomed by a lower gland membrane and connected to the crescent space through a port; and (b) a pumping piston being housed below and coupled with the power piston, being divided into a lower portion housing a suction tube and an upper portion with which a tubular casing is in a slidable relationship, that extends from bottom of an upper pressure chamber of the power piston, topped by the lowest gland membrane of the power piston, to top of a lower pressure chamber of the power piston, bottomed by a gland membrane which is permanently joined to the tubular casing and which is in a slidable relationship with the lower portion of the pumping piston, and having a number of gravity-biased poppet-type check valves that are interconnected by fluid-flow passages and that are arranged in a central cavity extending along the upper portion of the pumping piston except for an interruption by a plug which divides the poppet-type check valves into two groups.

14. The fluid extraction pump of claim 13 wherein, for extraction of crude oil, water or a mixture of crude oil and water, the tubular casings have an outside diameter of less than 45 mm for applications that are at least 3,000 meters deep and the well bore has a diameter of at least 50 mm.

15. The fluid extraction pump of claim 13 wherein the suction tube of the pumping piston has a dynamic, reciprocating, bi-directionally self-cleaning, suction filter comprising a screen support with conduction holes, a bi-dimensional filter screen that is separated by a limited, radial side clearance from a surrounding tubular casing and that extends around the screen support, a top cap and a bottom cap, with the top cap and the bottom cap, between which the screen support and the filter screen extend, being permanently joined to the screen support, with the bottom cap being confined by threaded sections to the suction tube and with a lock-nut fastening the suction filter to the suction tube.

16. The fluid extraction pump of claim 13 wherein the gravity-biased poppet-typed check valves of the pumping piston are replaced by spring-biased valves comprising fluted stops, which replace anvil stops used in gravity-biased poppet-type check valves, and a spring.

* * * * *